US006016602A

United States Patent [19]

Kanemitsu et al.

[11] Patent Number: 6,016,602

[45] Date of Patent: Jan. 25, 2000

[54] METHOD OF PRODUCING A SHEET METAL GEAR

[75] Inventors: Toshiaki Kanemitsu, Kobe; Shuji Kanemitsu, Kakogawa; Kazuyuki Oda, Hyogo-ken, all of Japan

[73] Assignee: Kabushiki Kaisha Kanemitsu, Hyogo-ken, Japan

[21] Appl. No.: 08/797,619

[22] Filed: Feb. 7, 1997

[30] Foreign Application Priority Data

Mar. 1, 1996 [JP] Japan ..... 8-044979

[51] Int. Cl.[7] ..... B21D 53/28

[52] U.S. Cl. ..... 29/893.32; 29/893.33; 72/110

[58] Field of Search ..... 29/893, 893.3, 29/893.32, 893.33; 72/68, 102, 108, 110

[56] References Cited

U.S. PATENT DOCUMENTS 1,670,475 5/1928 Nicholson ..... 29/893.33
3,729,967 5/1973 Bauknecht et al. ..... 29/893.32

*Primary Examiner*—P. W. Echols
*Attorney, Agent, or Firm*—Jones, Tullar & Cooper, P.C.

[57] ABSTRACT

The present invention relates to a method of producing a sheet metal gear in which a metal sheet (2) is used as a starting material and a gear is formed in the outer peripheral edge of the metal sheet. The object of the production method is to finish easily and accurately pitches of valleys and peaks of the gear which is formed in a simple production facility. The time period required for completing the formation of the gear in the outer peripheral edge of the metal sheet is shortened, thereby enhancing productivity. According to the production method, in the initial preparation step, a number of places of the outer peripheral edge of the circular metal sheet (2) which are arranged with a regular pitch are punched out in the axial direction, thereby forming preliminary valleys and preliminary peaks. Then, the method transfers to a gear forming step. In the gear forming step, a shaping roller which is rotated and follows the metal sheet increases the depth of the preliminary valleys to shape the valleys of the gear, and the height of the preliminary peaks to shape the peaks of the gear. The outer peripheral edge of the metal sheet is thickened as required before starting the preparation step.

2 Claims, 11 Drawing Sheets

METHOD OF PRODUCING A SHEET METAL GEAR

BACKGROUND OF THE INVENTION

1. Field of the Invention

The present invention relates to a method of producing a sheet metal gear, and more particularly to a sheet-metal gear production method in which a flat metal sheet is used as a starting material from which can be produced easily and accurately, not only gears of a small diameter but also gears of a relatively large diameter, such as a drive plate or a timing pulley used as a starter part of an automobile.

2. Description of the Prior Art

A prior art method of producing a ring-like gear such as a drive plate for an automobile using a flat sheet metal as a starting material is disclosed in Japanese Laid-Open Patent Publication No. 6-63670.

FIGS. 10 to 14 illustratively show the production method disclosed in this Japanese Patent Publication.

In the production method, a flat circular metal sheet 1 shown in FIG. 10 is used as a starting material. In an initial step, as shown in FIG. 11, an operation is performed in which the circular metal sheet 1 attached to a rotary die 101 is pressed radially inwardly by a die 102. As a result of this step, a cylindrical side plate portion 11 is formed by bending the outer periphery of the metal sheet 1. In the next step, as shown in FIG. 12, a two-layered bulge portion 12 is formed into a ring like shape in the base of the side plate portion 11 of the metal sheet 1 by the action of upper and lower pressing dies 103 and 104. In a further succeeding step shown in FIG. 13, an operation is conducted in which the bulge portion 12 is radially inwardly pressed by a die 105. As a result of this step, the bulge portion 12 (see FIG. 11) is thickened for formation as a gear portion 13.

After the thickened gear portion 13 is formed in the metal sheet 1 as described above, a step of shaping peaks and valleys in the gear portion 13 is conducted. In this step, as shown in FIG. 14, a shaping roller 106 is used. The shaping roller has a projecting valley-shaping face 107, and a recessed peak-shaping face 108. In this step, the shaping roller 106 and the metal sheet 1 are synchronously rotated while pressing the shaping roller 106 against the gear portion 13 (see FIG. 14) of the metal sheet 1. As a result of conducting this step, the places of the gear portion 13 of the metal sheet 1 with which the valley-shaping face 107 collides are recessed to be formed into valleys of a gear, and the places corresponding to the peak-shaping face 108 are projected to be formed into peaks of the gear.

In the prior art production method shown in FIGS. 10 to 14, the gear portion 13 has a flat peripheral face which is pressed by the valley-shaping face 107 and the peak-shaping face 108 of the shaping roller 106 in the initial stage of the step of shaping peaks and valleys in the gear portion 13 of the metal sheet 1. The pressing against the gear portion 13 having the flat peripheral face causes infant recesses of the valleys of the gear and infant projections of the peaks to be formed. Thereafter, the depth of each recessed place is gradually increased, and the height of each projected peak is gradually increased. Finally, valleys of an adequate depth and peaks of an adequate height are shaped.

In the production method, it is requested that the shaping roller 106 which is coupled to a rotation transmission mechanism, and the gear portion 13 of the metal sheet 1 are correctly synchronously rotated so that there never occurs slippage between the roller and the gear portion, because, when slippage between the two members occurs, the valleys and peaks of the gear cannot be shaped with correct pitches. Therefore, an accurate rotation transmission mechanism which can correctly synchronize rotation of the metal sheet 1 with that of the shaping roller 106 is required. This causes the cost of the production facility to be increased.

In the production method, the whole of the depth of each valley and that of the height of each peak of a gear are formed by rotating the shaping roller 106 and the metal sheet in specific directions while pressing the shaping roller 106 against the gear portion 13. Consequently, valleys and peaks of a resulting gear tend to have uneven thickness. In order to prevent such uneven thickness from occurring, it is effective to proceed with the shaping operation while repeatedly alternating the rotation directions of the metal sheet 1 and the shaping roller 106. However, this countermeasure complicates the production process. cl SUMMARY OF THE INVENTION It is an object of the present invention to finish easily and accurately pitches of valleys and peaks of a gear while employing a simple production facility and an uncomplicated production process.

It is another object of the present invention to remarkably shorten the time period required for completing the formation of a gear in the outer peripheral edge of a flat metal sheet, as compared with the prior art described above, thereby greatly enhancing productivity.

It is a further object of the present invention to economically produce a metal sheet gear by using a low cost production facility.

In order to attain these objects, the method of producing a sheet metal gear according to the present invention comprises: a preparation step of punching out a number of places at an outer peripheral edge of a metal sheet in an axial direction of the metal sheet, the places being arranged with a regular pitch, thereby forming preliminary valleys for the gear and preliminary peaks respectively existing between adjacent ones of the preliminary valleys; and a gear forming step of fitting a valley-shaping face of a shaping roller having a peak-shaping face and the valley-shaping face into the preliminary valleys, and the peak-shaping face of the shaping roller onto the preliminary peaks, and rotating the shaping roller while following the metal sheet and pressing the shaping roller against the metal sheet, thereby increasing the depth of the preliminary valleys of the metal sheet to form shaped valleys of the gear, and increasing the height of the preliminary peaks to form shaped peaks of the gear.

According to the production method, a roller which can rotate while following a metal sheet can be used as the shaping roller. Therefore, an accurate rotation transmission mechanism which is used in a conventional production facility and is used for synchronously rotating a metal sheet and a shaping roller is not required. This enables a simple and economical production facility to be used.

At a stage in which the preparation step of punching out the outer peripheral edge of a metal sheet to form preliminary valleys and peaks for a gear has been conducted, the correct pitches of the valleys and peaks of the gear for the final shaped product are determined. In the gear forming step, therefore, the preliminary valleys are accurately shaped into valleys of final shape, the preliminary peaks are accurately shaped into peaks of final shape, and the pitches of the peaks and valleys of the final shape are accurately formed, only by fitting the valley-shaping face of the shaping roller into the preliminary valleys, and the peak-shaping face of the shaping roller onto the preliminary peaks, and rotating the shaping roller while following the metal sheet and pressing the metal shaping roller against the metal sheet, i.e., by rotating the shaping roller together with the metal sheet.

In the production method, the procedure of increasing the depth of the preliminary valleys, which are previously formed by punching, and the height of the preliminary peaks, which are previously formed between adjacent ones of the preliminary valleys is carried out. As compared with the prior art method in which the entire valleys and peaks are formed by using a shaping roller as described above, therefore, the time period required for forming a gear in the outer peripheral edge of a metal sheet can be shortened, and the shortened time period enhances productivity.

The method of producing a sheet metal gear according to another aspect of the present invention comprises: a punching step of punching out a number of places of an outer peripheral edge of a metal sheet in an axial direction of the metal sheet, the places being arranged with a regular pitch, thereby forming valleys of the gear and peaks respectively existing between adjacent ones of the valleys; and a gear finishing step of fitting a valley-shaping face of a shaping roller having a peak-shaping face and the valley-shaping face into the valleys of the metal sheet, and the peak-shaping face of the shaping roller onto the peaks of the metal sheet, and rotating the shaping roller while following the metal sheet, thereby finishing surfaces of the valleys and the peaks of the metal sheet.

In the production method, the shaping roller is not used for increasing the depth of valleys and the height of peaks. In other words, the shaping roller used in the method is required only to serve to finish the surfaces of valleys and peaks of a metal sheet. In the production method, therefore, it is not necessary to carry out the above-mentioned procedure, i.e., the procedure of increasing the depth of the preliminary valleys and the height of the preliminary peaks by a shaping roller, and hence the time period for executing the procedure can be saved. This serves to remarkably shorten the time period required for forming a gear in the outer peripheral edge of a metal sheet, and also to greatly enhance the productivity.

When either of the two production methods described above is employed, it is effective to use a metal sheet having a thickness which is equal to that of the peaks of a gear to be shaped. Alternatively, a metal sheet having a thickness which is smaller than that of the peaks of a gear to be shaped may be used. In the case where a metal sheet having a thickness which is smaller than that of the peaks of a gear to be shaped is used, it is preferable to thicken the outer peripheral edge of the metal sheet before the preparation step or the punching step. When a method in which a metal sheet having a thickness which is smaller than that of the peaks of a gear to be shaped is used is employed, the weight and cost of a metal sheet used as the starting material can be reduced. This produces an advantage in that the reduction serves to suppress the material cost to a low level.

DETAILED DESCRIPTION OF THE PREFERRED EMBODIMENT

FIGS. 1 to 6 show the method of the present invention which produces a metal sheet gear as a final product by using a metal sheet 2 as a starting material, in a sequence of steps. In each of FIGS. 1 to 6, (A) illustratively shows a method of executing the corresponding step, and (B) is a schematic perspective view showing the metal sheet material obtained as a result of conducting the corresponding step. In the embodiment, a circular metal sheet having a thickness which is smaller than that of the peaks of a gear to be shaped is used as the metal sheet 2 serving as the starting material.

Figure 1A:
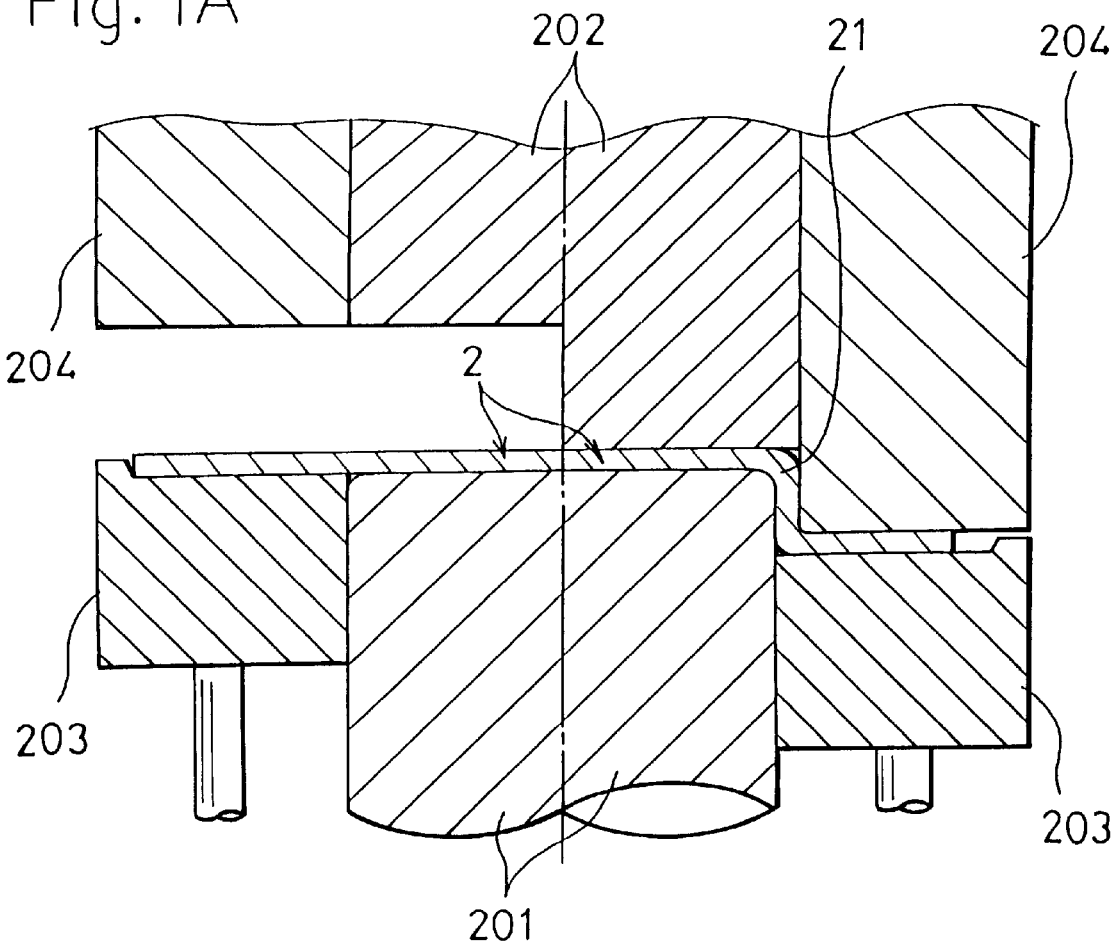
FIG. 1(A) is a diagram illustrating a drawing step.
Figure 1B:
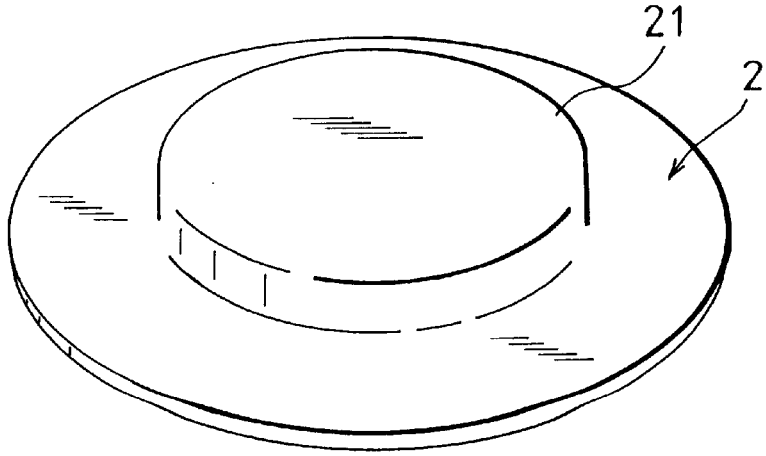
FIG. 1(B) is a schematic perspective view of a material obtained as a result of conducting the drawing step.

FIG. 1(A) shows a drawing step of forming a bulge portion 21 in the center of the metal sheet 2. As shown in the left half of FIG. 1(A), the circular metal sheet 2 is placed between a support die 201 and a press die 202 which are opposed to each other. First and second drawing dies 203 and 204 are disposed on the outer periphery of the support die 201 and the press die 202. In the drawing step, as shown in the right half of FIG. 1(A), the metal sheet 2 is clamped and fixed by the support die 201 and the press die 202. Thereafter, the first and second drawing dies 203 and 204 cooperate to press down the outer periphery of the metal sheet 2. This operation comprises a drawing operation. As a result of this step, a stepped bulge portion 21 is concentrically formed by drawing in the center of the metal sheet 2 as shown in FIG. 1(B). A drilling process or a burring process is applied to the bulge portion 21 so as to complete the formation of a desired mechanical portion such as a boss.

Figure 2A:
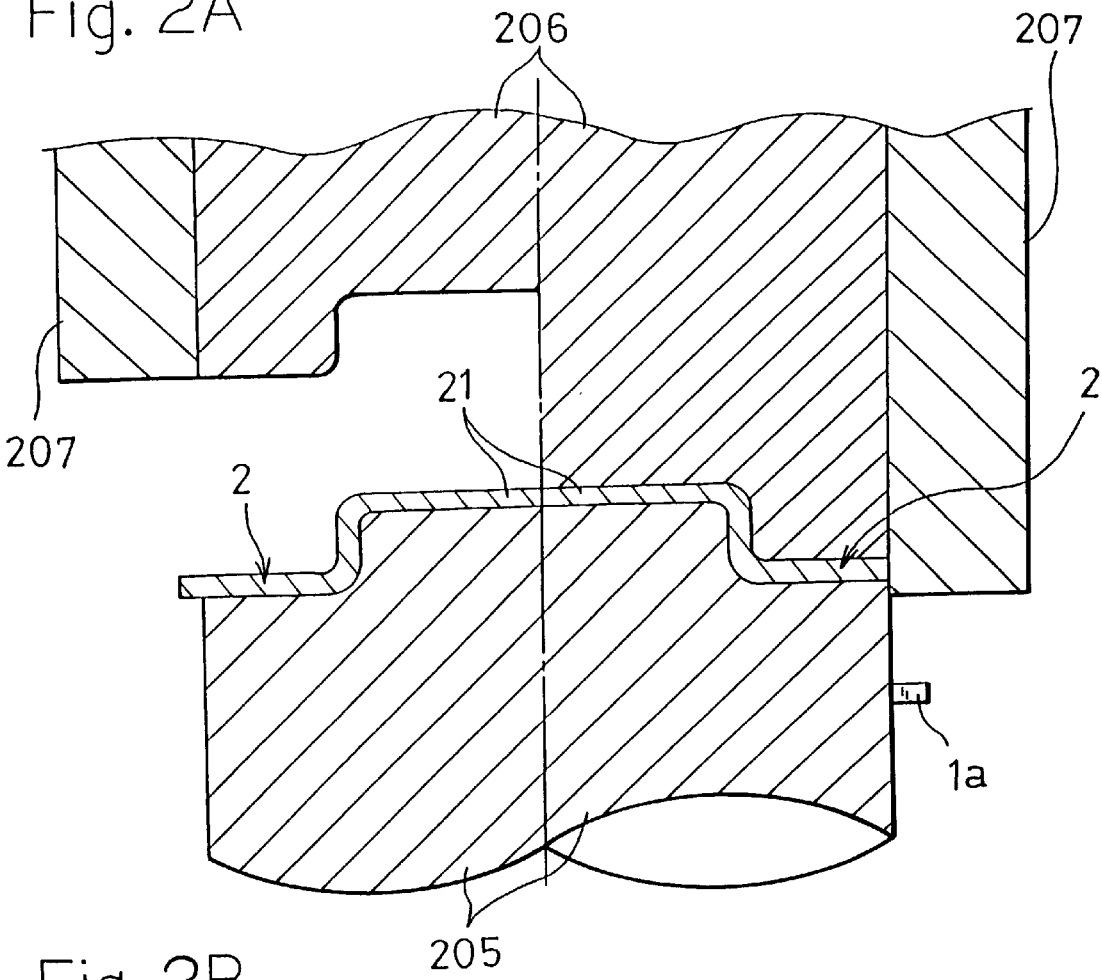
FIG. 2(A) is a diagram illustrating a pressing step.
Figure 2B:
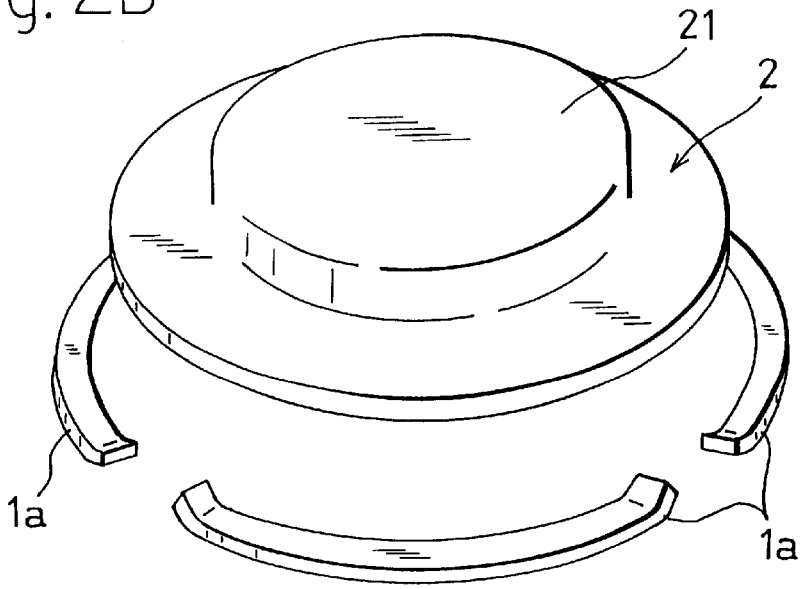
FIG. 2(B) is a schematic perspective view of the material obtained as a result of conducting the pressing step.

FIG. 2(A) shows a pressing step in which the outer periphery of the metal sheet 2 having the bulge portion 21 is punched out to adjust the circular shape of the metal sheet 2. As shown in the left half of FIG. 2(A), the metal sheet 2 which has undergone the drawing step is placed between a support die 205 and a press die 206 which are opposed to each other. A blanking die 207 is disposed on the outer periphery of the press die 206. In the pressing step, as shown in the right half of FIG. 2(A), the metal sheet 2 is clamped and fixed by the support die 205 and the press die 206, and thereafter the outer periphery of the metal sheet 2 is punched out by the blanking die 207. As a result of conducting this step, the circular shape of the metal sheet 2 having the stepped bulge portion 21 in the center is adjusted as shown in FIG. 2(B). The reference numeral 1*a* designates a waste material which is produced by the punching operation.

Figure 3A:
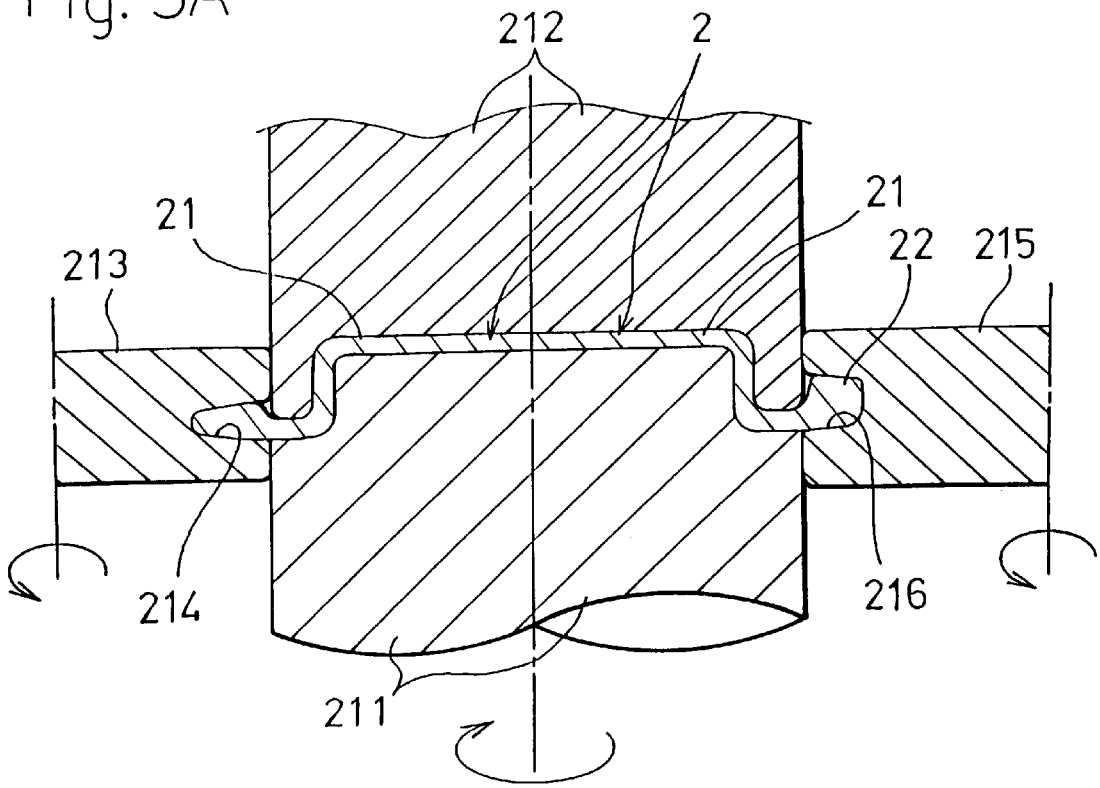
FIG. 3(A) is a diagram illustrating a thickening step.

FIG. 3(A) shows a step of thickening the outer peripheral edge of the metal sheet 2 which has undergone the pressing step. In the thickening step, the metal sheet 2 which has undergone the pressing step is clamped and fixed by first and second rotary dies 211 and 212, and a rotation force is transmitted to the first rotary die 211 from a rotation driving source, which is not shown, so that the second rotary die 212 and the metal sheet 2 are rotated together with the first rotary die 211. As a first stage, a grooved shaping face 214 of a first press shaping roller 213 is pressed radially inwardly against the outer peripheral edge of the metal sheet 2 as shown in the left half of FIG. 3(A). As a second stage, a grooved shaping face 216 of a second press shaping roller 215 is pressed radially inwardly against the outer peripheral edge of the metal sheet 2 as shown in the right half of FIG. 3(A). The groove width of the grooved shaping face 216 of the second press shaping roller 215 is larger than that of the grooved shaping face 214 of the first press shaping roller 213. The groove depth of the grooved shaping face 216 of the second press shaping roller 215 is smaller than that of the grooved shaping face 214 of the first press shaping roller 213. Therefore, the outer peripheral edge of the metal sheet 2 which is slightly thickened by the pressing operation conducted by the grooved shaping face 214 of the first press shaping roller 213 is further thickened by the pressing operation conducted by the grooved shaping face 216 of the second press shaping roller 215. The first and second press shaping rollers 213 and 215 are caused to rotate while following the metal sheet 2, by pressing the rollers against the metal sheet 2.

Figure 8A:
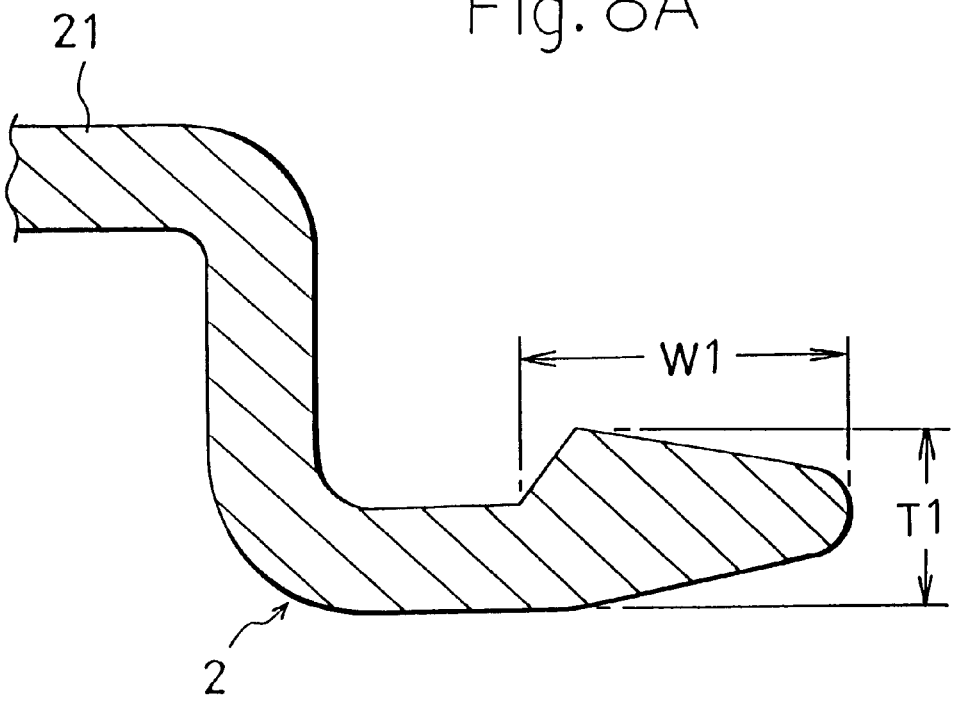
FIG. 8(A) is a diagram showing a section shape of the outer peripheral edge of a metal sheet which is thickened by a first press shaping roller.
Figure 8B:
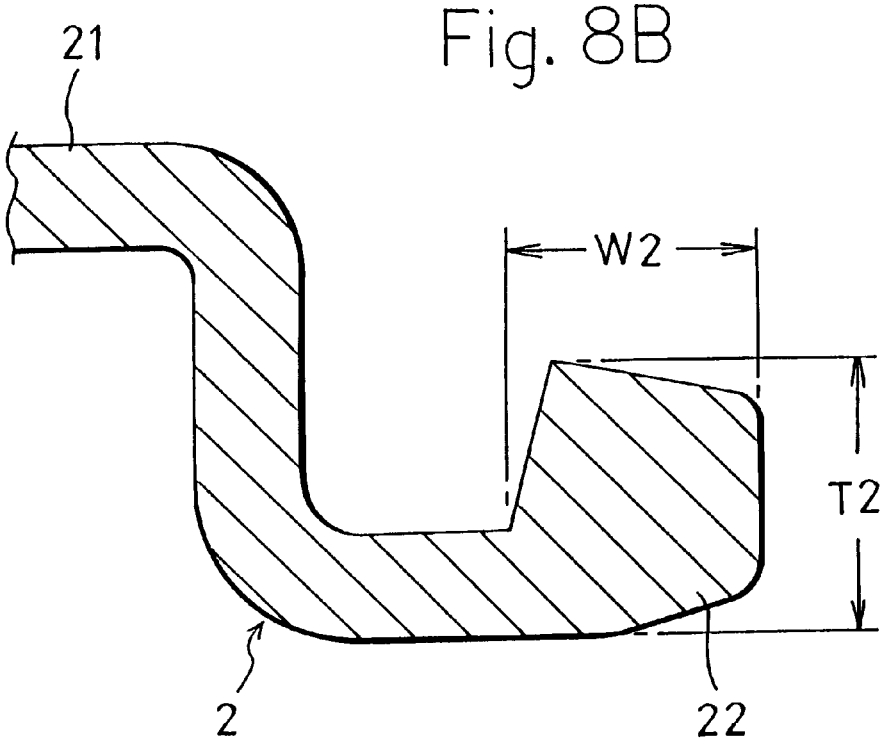
FIG. 8(B) is a diagram showing a section shape of the outer peripheral edge of the metal sheet which is thickened by a second press shaping roller.

FIG. 8(A) shows a section shape of the outer peripheral edge of the metal sheet 2 which is thickened by the first press shaping roller 213, and FIG. 8(B) shows a section shape of the outer peripheral edge of the metal sheet 2 which is thickened by the second press shaping roller 215. As seen from a comparison of FIGS. 8(A) and 8(B), the outer peripheral edge of the metal sheet 2 is thickened by the first press shaping roller 213 so as to have a thickness T1, and the thus thickened portion is further thickened by the second press shaping roller 215 so as to have a thickness T2 (T2>T1). The thickened portion has a width W1 at the time when the thickening operation is conducted by the first press shaping roller 213, and a width W2 (W2<W1) at the time when the thickening operation is conducted by the second press shaping roller 215. When the thickening operation is conducted in plural stages as described above, the outer peripheral edge of the metal sheet 2 is thickened without undue stress so as to have a desired thickness. This thickening is due to plastic deformation of the outer peripheral edge of the metal sheet 2.

Figure 3B:
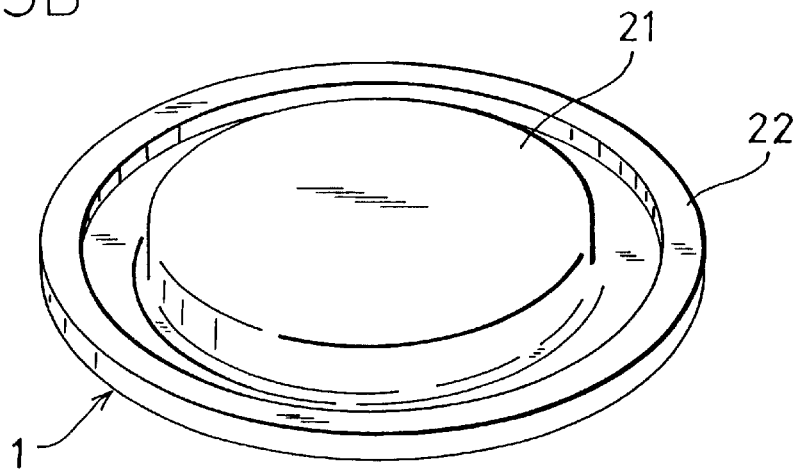
FIG. 3(B) is a schematic perspective view of the material obtained as a result of conducting the thickening step.

The metal sheet 2 which has undergone the thickening step is provided at the outer peripheral edge with a gear portion 22 which is thickened so as to have a section shape as shown in FIG. 8(B). The metal sheet 2 is shown in FIG. 3(B).

Figure 4A:
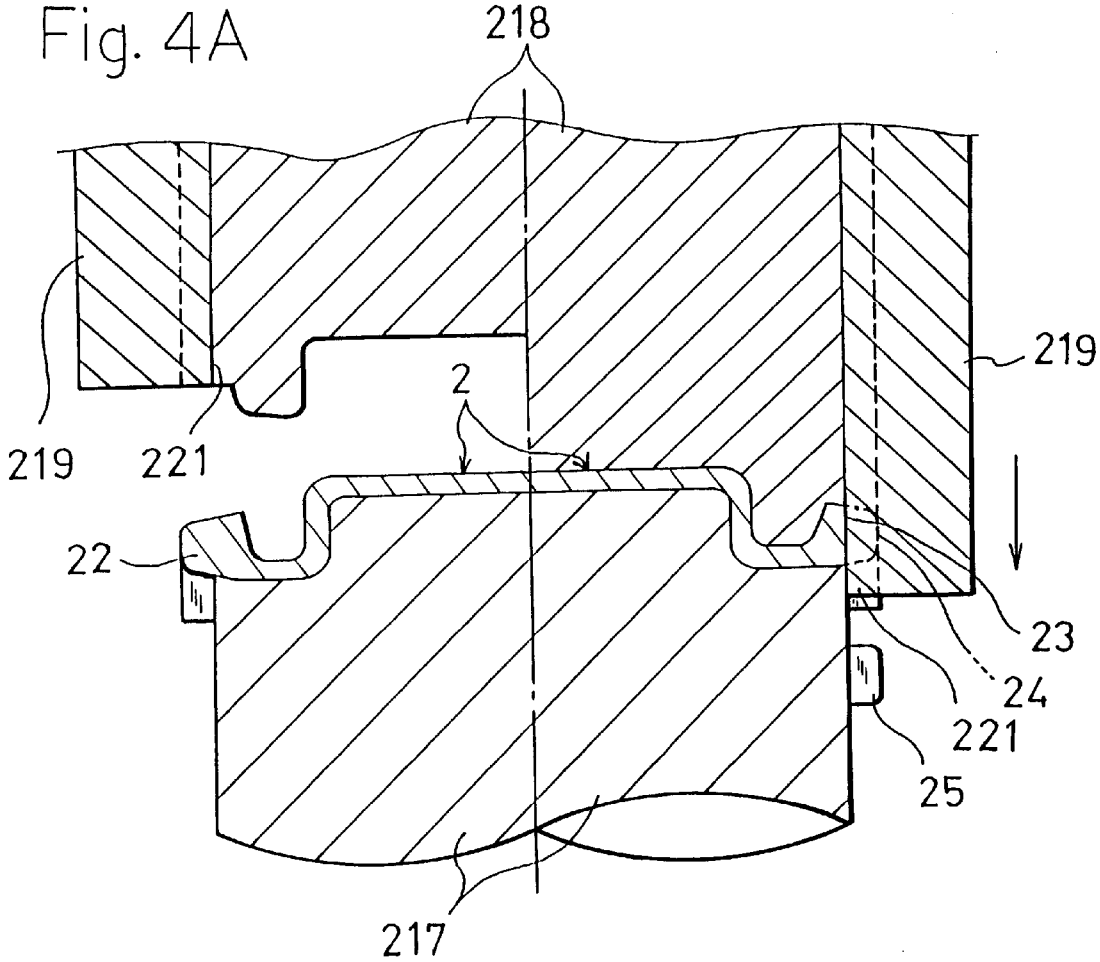
FIG. 4(A) is a diagram illustrating a preliminary-valley forming step.

FIG. 4(A) shows a preparation step of forming preliminary valleys 23 and preliminary peaks 24. In the preparation step, the metal sheet 2 which has undergone the thickening step is placed between third and fourth rotary dies 217 and 218 for punching. In the initial stage of the preparation step, as shown in the left half of FIG. 4(A), the fourth rotary die 218 and a punching die 219 are opposed to the metal sheet 2 mounted on the third rotary die 217 for punching. Thereafter, as shown in the right half of FIG. 4(A), the metal sheet 2 is clamped and fixed by the third and fourth rotary dies 217 and 218, and the punching die 219 is then operated so that a number of places which are arranged with a regular pitch in the gear portion 22 corresponding to the outer peripheral edge of the metal sheet 2 are punched out in the axial direction of the metal sheet 2. The punching die 219 used in this step has a punching projection 221 which is similar in shape to the valleys of a gear to be shaped. The preliminary valleys 23 for the gear and preliminary peaks respectively existing between adjacent ones of the preliminary valleys are formed by punching out the gear portion 22 by the punching die 219.

Figure 4B:
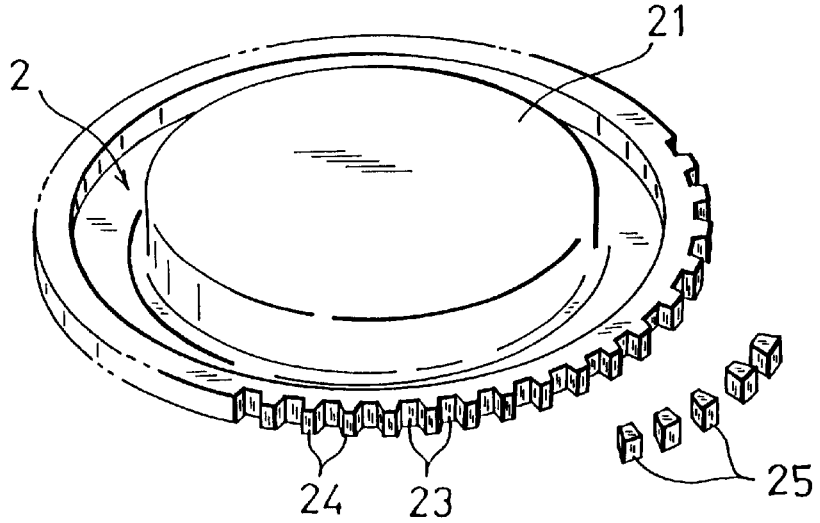
FIG. 4(B) is a schematic perspective view of the material obtained as a result of conducting the preliminary-valley forming step.

In the process of punching out the gear portion 22 of the metal sheet 2 by the punching die 219 in the preparation step, the places arranged with a regular pitch can be punched out so that the preliminary valleys 23 and the preliminary peaks 24 are formed one by one along the whole periphery of the gear portion 22 with a regular pitch, by a procedure in which the metal sheet 2 is intermittently rotated in the steps through a constant angle by the third rotary die 217 and the punching die 219 having a single punching projection 221 is operated at each stop of the rotation. Alternatively, the places arranged with a regular pitch can be punched out so that the preliminary valleys 23 and the preliminary peaks 24 are formed as plural units along the whole periphery of the gear portion 22 with a regular pitch, by a procedure in which the metal sheet 2 is intermittently rotated in steps through a constant angle by the third rotary die 217 and the punching die 219 having plural punching projections 221 is operated at each step of the rotation. In a further alternative, the preliminary valleys 23 with a regular pitch are punched out in the whole periphery of the gear portion 22 at one time so that the preliminary peaks 24 are formed at one time, by a method in which the third rotary die 217 is stopped and the punching die 219 having a number of punching projections 221 annularly arranged with a regular pitch is operated. In FIG. 4B, 25 designates a waste material which is produced by the punching operation.

Figure 9A:
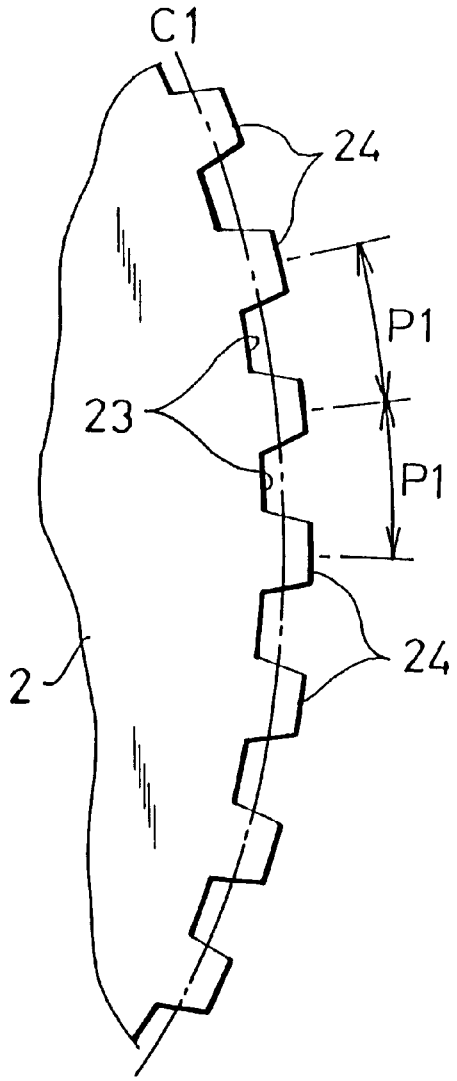
FIG. 9(A) is a diagram showing shapes of preliminary valleys and preliminary peaks of a metal sheet.
Figure 9B:
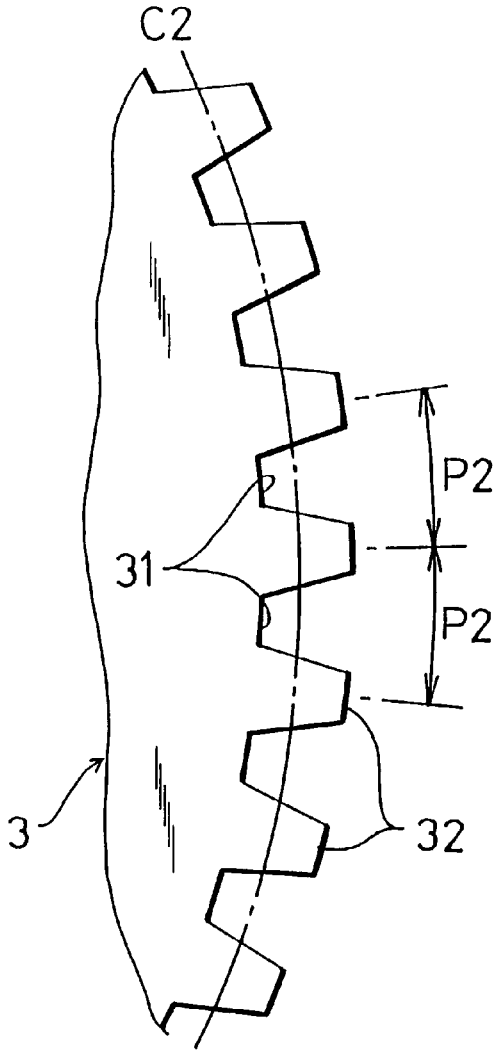
FIG. 9(B) is a diagram showing shapes of valleys and peaks of a sheet metal gear which is a final shaped product.
Figure 10:
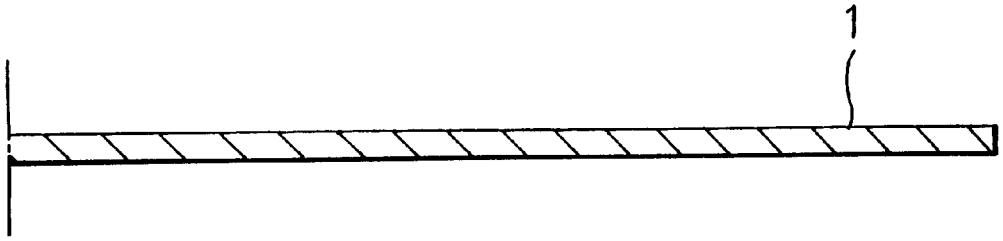
Fig. 10 (PRIOR ART)
FIG. 10 is a partial section view of a metal sheet which is used as a starting material in a prior art method.
Figure 11:
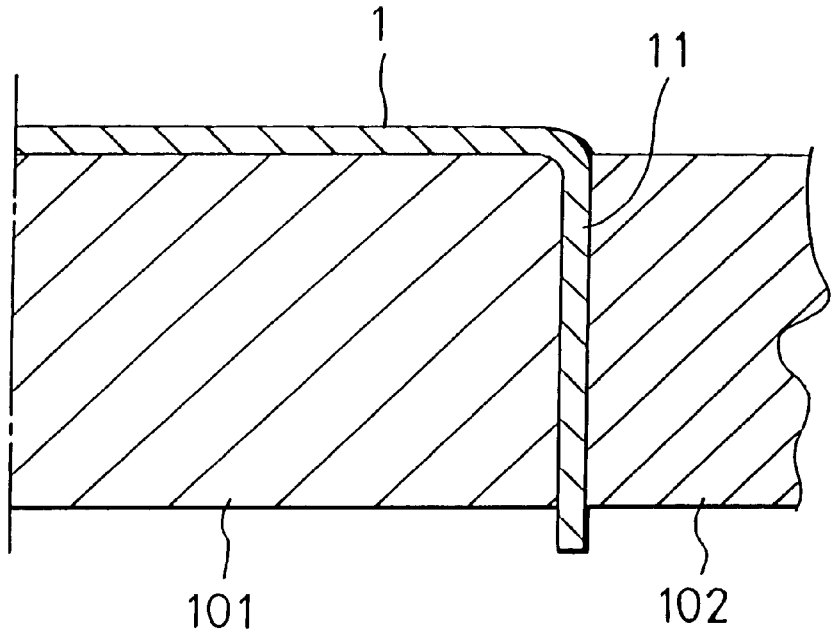
Fig. 11 (PRIOR ART)
FIG. 11 is a partial section view showing a step of forming of a side plate portion in the prior art method.
Figure 12:
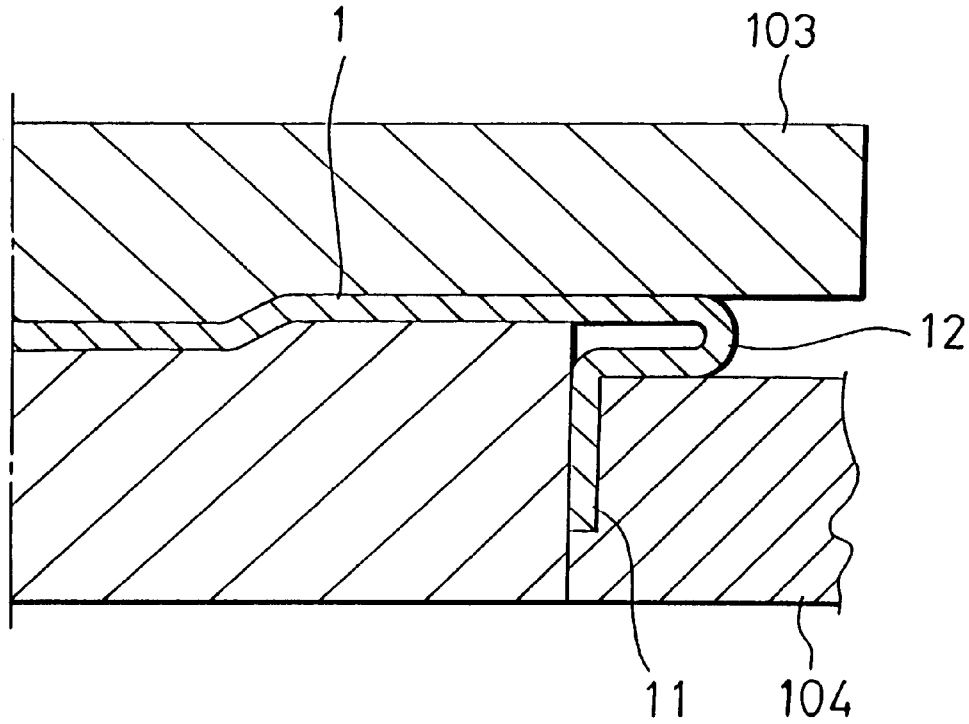
Fig. 12 (PRIOR ART)
FIG. 12 is a partial section view showing a step of forming of a bulge portion in the side plate portion in the prior art method.
Figure 13:
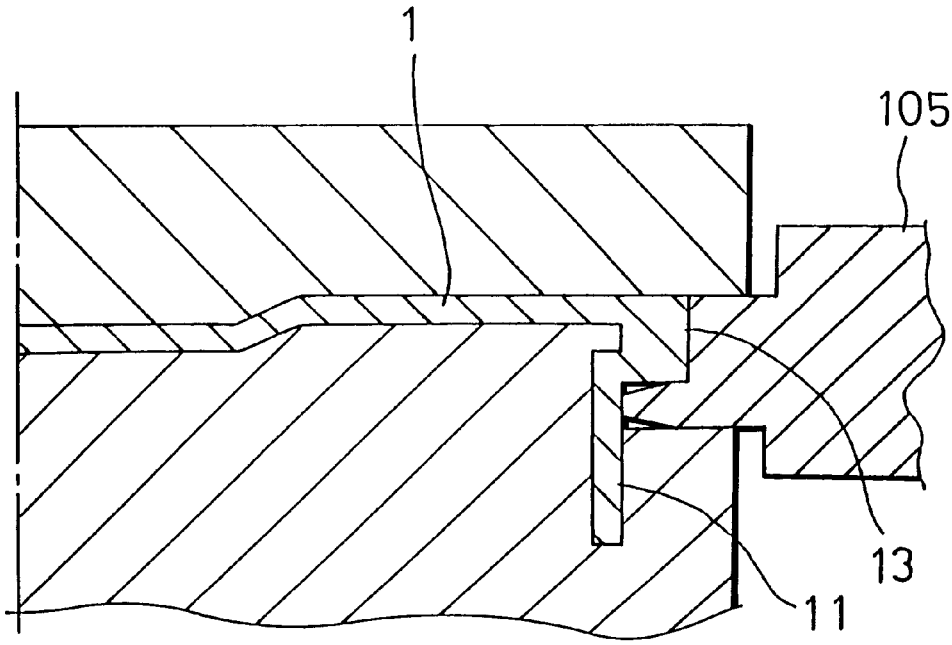
Fig. 13 (PRIOR ART)
FIG. 13 is a partial section view showing a step of thickening the bulge portion in the prior art method.
Figure 14:
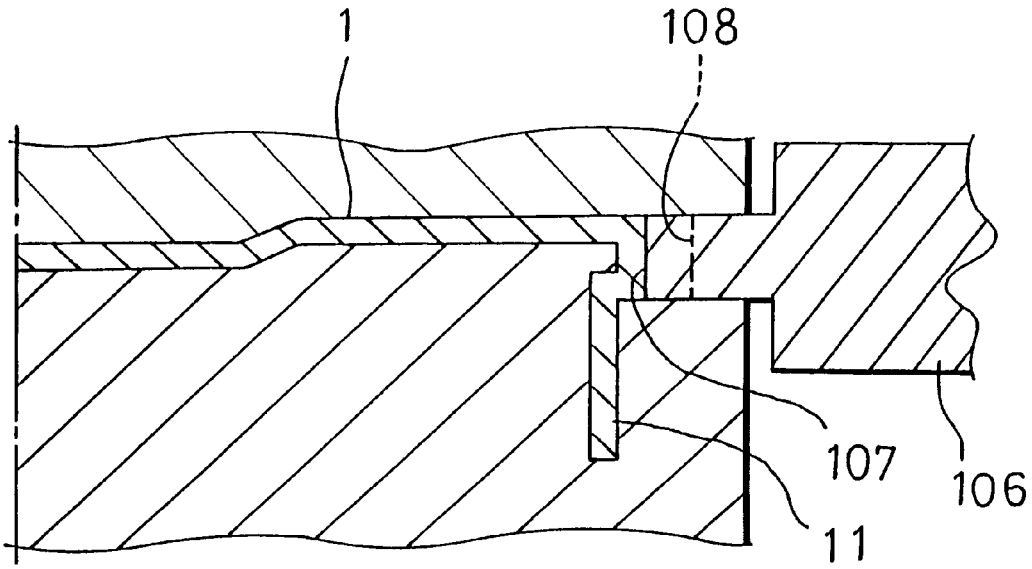
Fig. 14 (PRIOR ART)
FIG. 14 is a partial section view showing a step of shaping peaks and valleys in a thickened gear portion in the prior art method.

The preliminary valleys 23 and the preliminary peaks 24 of the metal sheet 2 which are formed as a result of conducting the preparation step are shaped into valleys 31 and peaks 32 of a metal sheet gear 3 in a gear forming step (see FIG. 9). Although the gear forming step will be described in detail later, the gear forming step will be briefly described. In the gear forming step, the depth of the preliminary valleys 23 of the metal sheet 2 is increased so that the valleys 31 of the sheet metal gear 3 are shaped, and the height of the preliminary peaks 24 is increased so that the peaks 32 of the sheet metal gear 3 are shaped. FIG. 9(A) illustratively shows the shapes of the preliminary valleys 23 and the preliminary peaks 24 of the metal sheet 2 which are obtained as a result of conducting the preparation step, and FIG. 9(B) illustratively shows the shapes of the valleys 31 and the peaks 32 of the sheet metal gear which is a final shaped product. As seen from a comparison of FIGS. 9(A) and 9(B), the pitch P2 of the valleys 31 and the peaks 32 (in FIG. 9, the pitch is indicated as the pitch of the peaks 32) of the metal sheet gear 3 which is a final shaped product is equal to the pitch P1 of the preliminary valleys 23 and the preliminary peaks 24 (in FIG. 9, the pitch is indicated as the pitch of the preliminary peaks 24) of the metal sheet 2 which has undergone the preparation step (P1=P2). Therefore, the preparation step must be conducted so that the pitch of the preliminary valleys 23 and the preliminary peaks 24 which are formed in the preparation step of FIG. 4 functions as is the same as the pitch of the valleys 31 and the peaks 32 of the metal sheet gear 3 which is a final shaped product. This can be easily realized by executing the preparation step in the procedure described above.

Figure 5A:
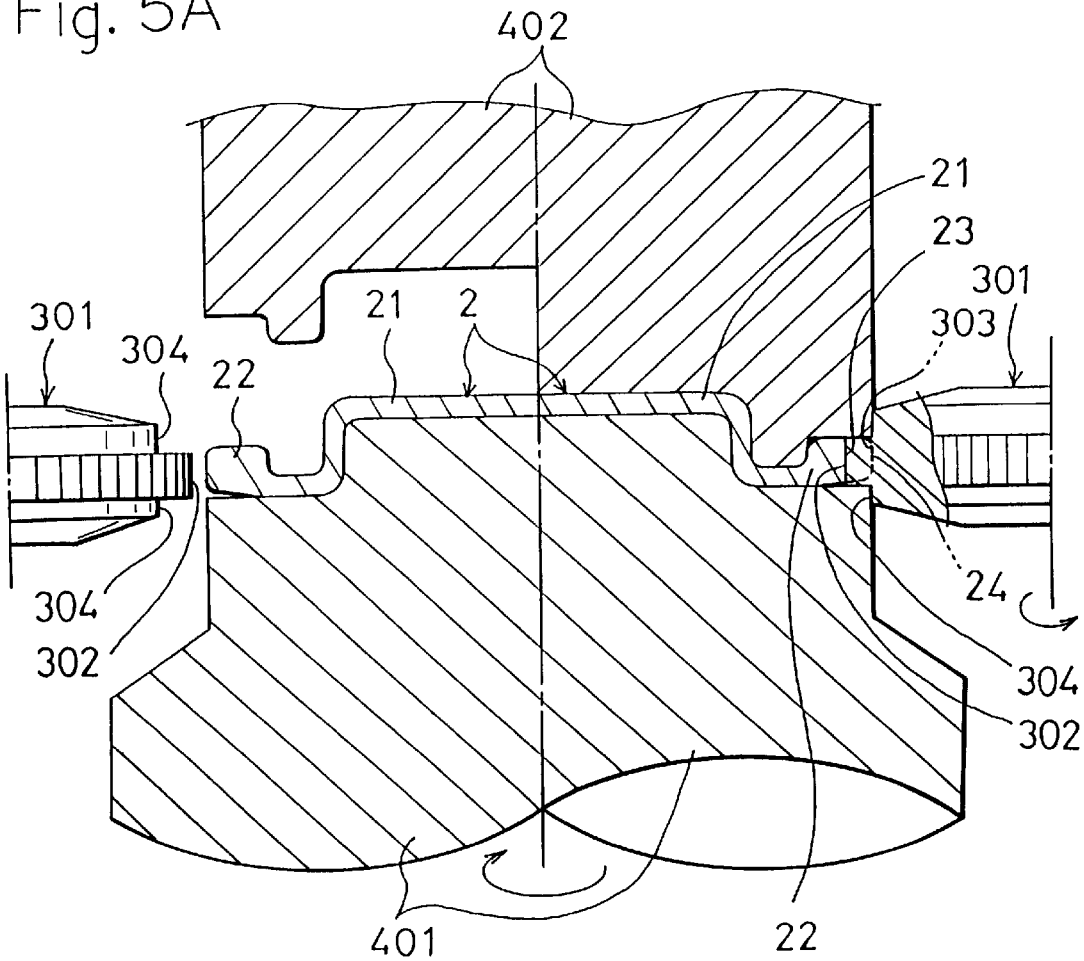
FIG. 5(A) is a diagram illustrating a first example of a shaping step.
Figure 5B:
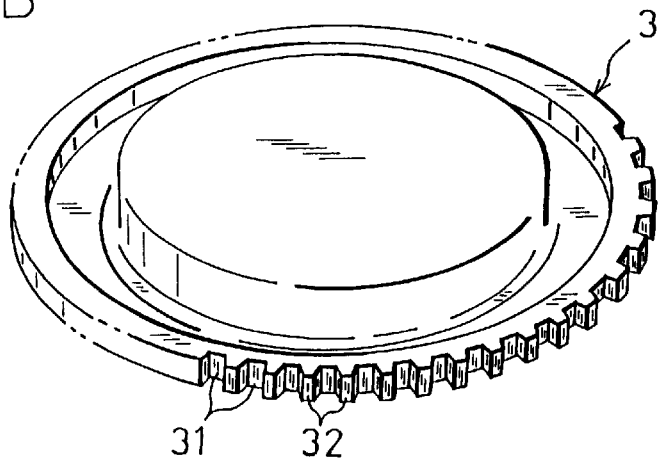
FIG. 5(B) is a schematic perspective view of a gear obtained as a result of conducting the first example of the shaping step.
Figure 6A:
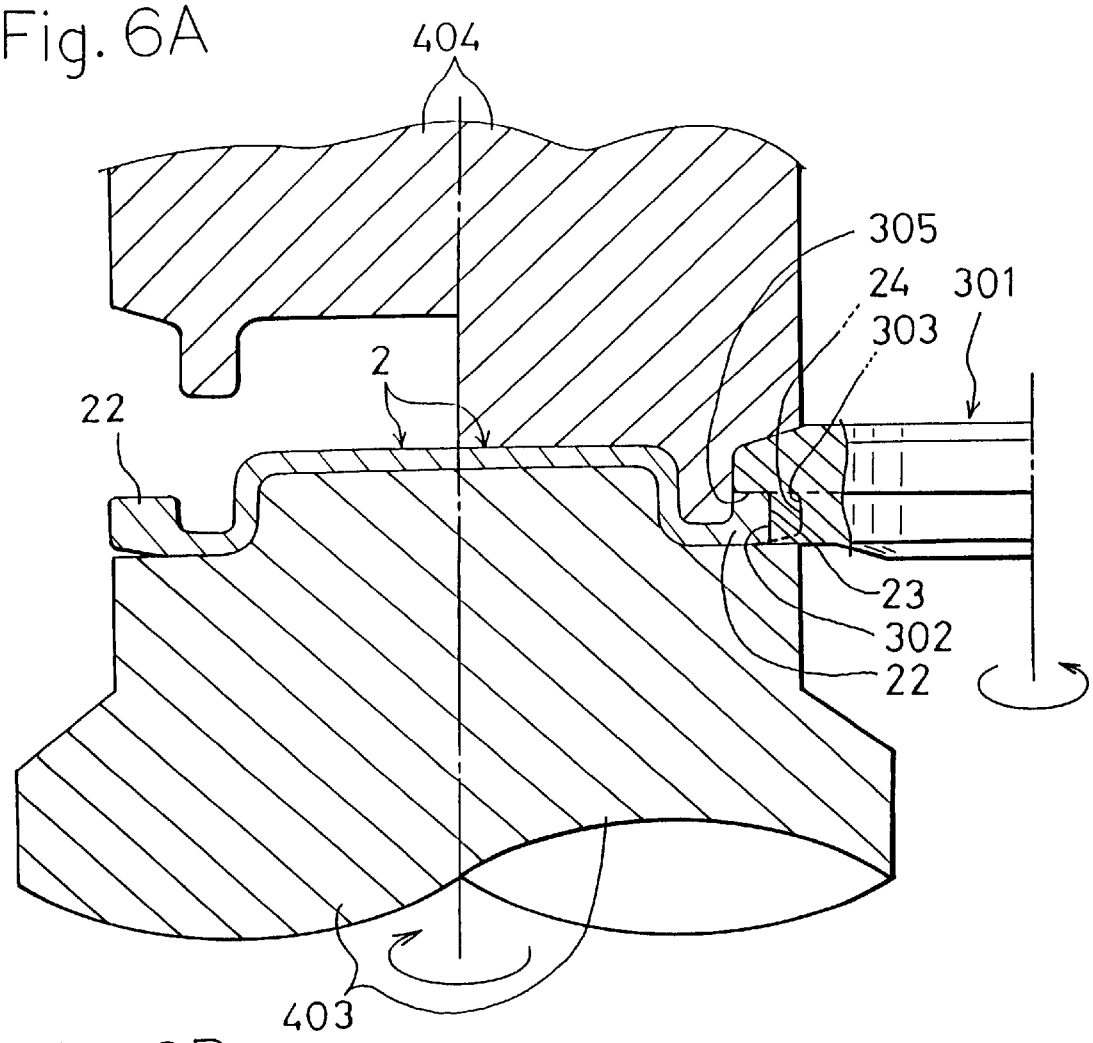
FIG. 6(A) is a diagram illustrating a second example of the shaping step.
Figure 6B:
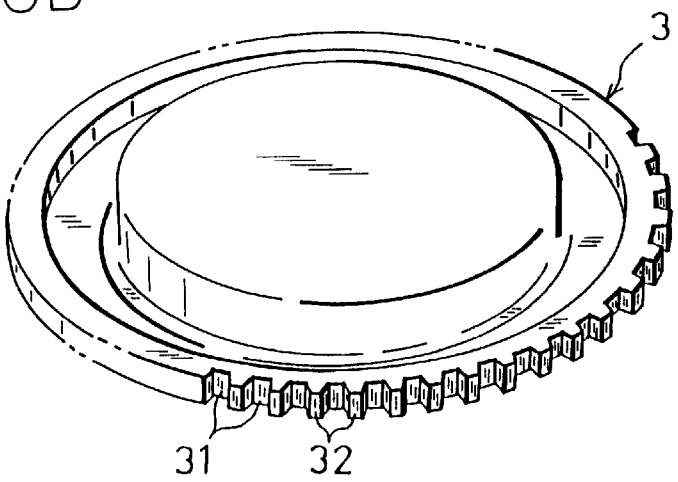
FIG. 6(B) is a schematic perspective view of a gear obtained as a result of conducting the second example of the shaping step.
Figure 7A:
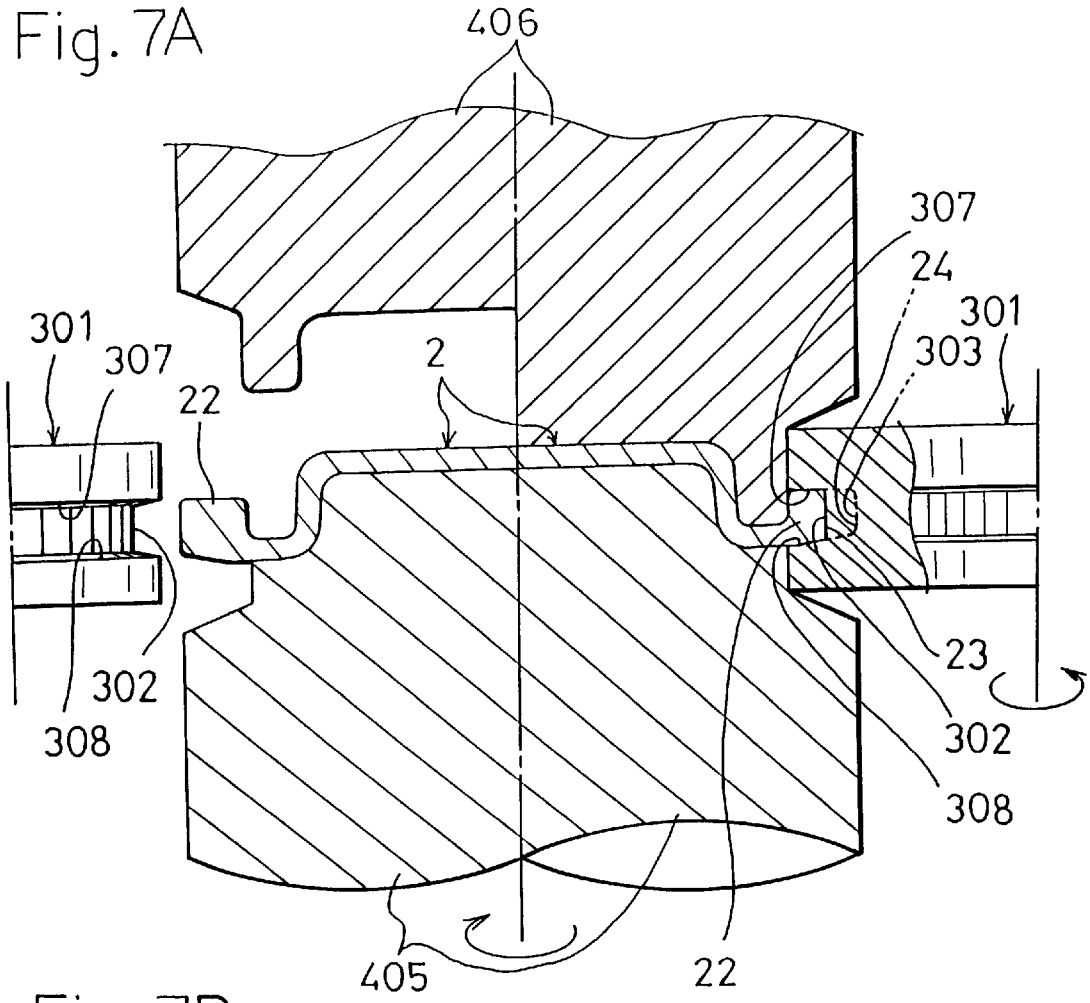
FIG. 7(A) is a diagram illustrating a third example of the shaping step.
Figure 7B:
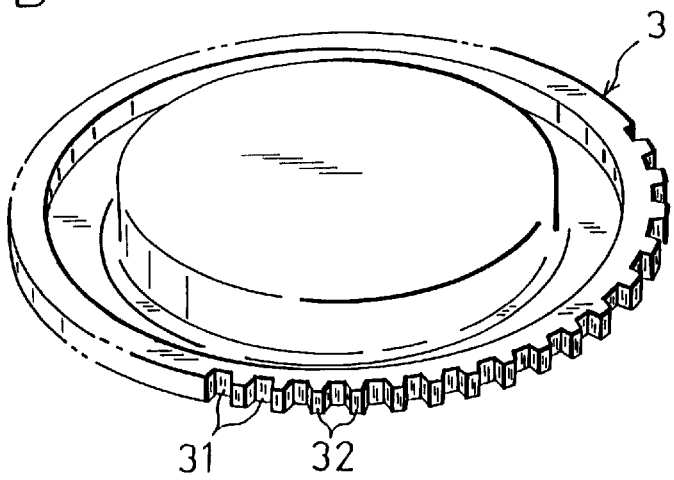
FIG. 7(B) is a schematic perspective view of a gear obtained as a result of conducting the third example of the shaping step.

FIGS. 5(A), 6(A), and 7(A) show first, second, and third examples of the gear forming step, respectively. In FIGS. 5(B), 6(B), and 7(B), the gears 3 which have been produced as a result of conducting the respective gear forming steps are shown. The gears 3 have the same shape.

In all the first to third examples of the gear forming step, a shaping roller 301 is used. In each of the shaping rollers 301, a valley-shaping face 302 which projects outwardly, and a peak-shaping face 303 which is recessed are formed on the outer periphery. In the shaping roller 301 used in the first example of the gear forming step, as shown in FIG. 5(A), the outer periphery having the valley-shaping face 302 and the peak-shaping face 303 is projected from an outer peripheral face 304 on both sides in the axial direction. In the shaping roller 301 used in the second example of the shaping step, as shown in FIG. 6(A), a flat annular shaping face 305 is disposed so as to be adjacent to one side in the axial direction of the outer periphery having the valley-shaping face 302 and the peak-shaping face 303. In the shaping roller 301 used in the third example of the shaping step, as shown in FIG. 7(A), flat annular shaping faces 307 and 308 are disposed so as to be adjacent to the sides in the axial direction of the outer periphery having the valley-shaping face 302 and the peak-shaping face 303.

Next, the first to third examples of the shaping step will be described in detail.

In the first example shown in FIG. 5(A), the metal sheet 2 which is obtained as a result of conducting the preparation step is placed between fifth and sixth rotary dies 401 and 402. In the initial stage of this step, as shown in the left half of FIG. 5(A), the sixth rotary die 402 and the shaping roller 301 are opposed to the metal sheet 2 mounted on the fifth rotary die 401. Thereafter, as shown in the right half of FIG. 5(A), the metal sheet 2 is clamped and fixed by the fifth and sixth rotary dies 401 and 402, and the shaping roller 301 is then moved toward the metal sheet 2 while rotating the fifth rotary die 401. The valley-shaping face 302 of the shaping roller 301 is fitted into the preliminary valleys 23 of the metal sheet 2, and the peak-shaping face 303 is fitted onto the preliminary peaks 24 of the metal sheet 2. The shaping roller 301 is rotated while following the metal sheet 2 and pressed against the metal sheet 2, whereby the depth of the preliminary valleys 23 of the metal sheet 2 is increased by means of plastic deformation so that the valleys 31 of the gear 3 are shaped, and the height of the preliminary peaks 24 is increased by means of plastic deformation so that the peaks 32 of the gear 3 are shaped. During the period when this gear forming step is conducted, the back and front faces of the gear portion 22 of the metal sheet 2 are clamped by the fifth and sixth rotary dies 401 and 402. Even when burrs are formed in the gear portion 22 in the above-mentioned preliminary-valley forming step, therefore, the burrs are eliminated in the shaping step.

Also in the second example shown in FIG. 6(A), the metal sheet 2 which has undergone the preparation step is placed between seventh and eighth rotary dies 403 and 404. In the initial stage of this step, as shown in the left half of FIG. 6(A), the eighth rotary die 404 and the shaping roller 301 (in the left half of FIG. 6(A), the roller is not shown) are opposed to the metal sheet 2 mounted on the seventh rotary die 403. Thereafter, as shown in the right half of FIG. 6(A), the metal sheet 2 is clamped and fixed by the seventh and eighth rotary dies 403 and 404, and the shaping roller 301 is then moved toward the metal sheet 2 while rotating the seventh rotary die 403. The valley-shaping face 302 of the shaping roller 301 is fitted into the preliminary valleys 23 of the gear portion 22 of the metal sheet 2, and the peak-shaping face 303 is fitted onto the preliminary peaks 24. The shaping roller 301 is rotated while following the metal sheet 2 while being pressed against the metal sheet 2, whereby the depth of the preliminary valleys 23 of the metal sheet 2 is increased by means of plastic deformation so that the valleys 31 of the gear 3 are shaped, and the height of the preliminary peaks 24 is increased by means of plastic deformation so that the peaks 32 of the gear 3 are shaped. During the period when this shaping step is conducted, the back face of the gear portion 22 of the metal sheet 2 is pressed by the seventh rotary die 403, and the front face of the gear portion 22 rubs against the annular shaping face 305 of the shaping roller 301. Therefore, burrs which are formed in the gear portion 22 in the above-mentioned preliminary-valley forming step are eliminated.

Also in the third example shown in FIG. 7(A), the metal sheet 2 which has undergone the preliminary-valley forming step is placed between ninth and tenth rotary dies 405 and 406. In the initial stage of this step, as shown in the left half of FIG. 7(A), the tenth rotary die 406 and the shaping roller 301 are opposed to the metal sheet 2 mounted on the ninth rotary die 405. Thereafter, as shown in the right half of FIG. 7(A), the metal sheet 2 is clamped and fixed by the ninth and tenth rotary dies 405 and 406, and the shaping roller 301 is then moved toward the metal sheet 2 while rotating the ninth rotary die 405. The valley-shaping face 302 of the shaping roller 301 is fitted into the preliminary valleys 23 of the gear portion 22 of the, metal sheet 2, and the peak-shaping face 303 is fitted onto the preliminary peaks 24. The shaping roller 301 is rotated while following the metal sheet 2 and pressed against the'metal sheet 2, whereby the depth of the preliminary valleys 23 of the, metal sheet 2 is increased by means of plastic deformation so that the valleys 31 of the gear 3 are shaped, and the height of the preliminary peaks 24 is increased by means of plastic deformation so that the peaks 32 of the gear 3 are shaped. During the period when this shaping step is conducted, the back face of the gear portion 22 of the metal sheet 2 rubs against the annular shaping face 308 of the shaping roller 301, and the front face of the gear portion 22 rubs against the annular shaping face 307 of the shaping roller 301. Therefore, burrs which are formed in the gear portion 22 in the above-mentioned preliminary-valley forming step are eliminated.

In the above-described first to third examples of the shaping step, the valley-shaping face 302 and the peak-shaping face 303 of the shaping roller 301 are rotated while following the metal sheet 2 while being respectively engaged with the preliminary valleys 23 and the preliminary peaks 24 of the metal sheet 2. Furthermore, the pitches of the preliminary valleys 23 and the preliminary peaks 24 of the metal sheet 2 are set in the preparation step so as to correctly coincide with those of the valleys 31 and the peaks 32 of the sheet metal gear 3 to be shaped. Therefore, the valleys 31 are accurately shaped from the preliminary valleys 23 and the peaks 32 are accurately shaped from the preliminary peaks 24 only by rotating the shaping roller 301 while following the metal sheet 2 while fitting the valley-shaping face 302 of the shaping roller 301 into the preliminary valleys 23 of the gear portion 22 and pressing the face against the preliminary valleys. As a result, the pitches of the peaks 32 and the valleys 31 are adequate i.e., are the same.

As seen from a comparison of FIGS. 9(A) and 9(B), the depth of the valleys 31 of the metal sheet gear 3 which is a final shaped product is larger than that of the preliminary valleys 23 of the metal sheet 2 which has undergone the preliminary-valley forming step, and the height of the peaks 32 is larger than that of the preliminary peaks 24. In FIGS. 9(A) and 9(B), the one-dot chain lines Cl and C2 indicate the pitch circles.

In the above-described embodiment, a metal sheet having a thickness which is smaller than that of the peaks 32 of the gear 3 to be shaped is used as the metal sheet 2, and the outer peripheral edge of the metal sheet 2 is thickened in the thickening step shown in FIG. 3 and precedent to the preparation step in which a number of places arranged with a regular pitch in the outer peripheral edge of the metal sheet 2 are punched out in the axial direction of the metal sheet 2, thereby forming the preliminary valleys 23.

Alternatively, as the metal sheet 2, a circular metal sheet which is equal in thickness to the peaks 32 of the gear 3 to be shaped may be used. When such a thick metal sheet is initially used, the above-mentioned thickening step is not required, and the preparation step can be conducted without performing the thickening step.

In the case where a circular metal sheet which is smaller in thickness than the peaks 32 of the gear 3 to be shaped is used as the metal sheet 2, the step of thickening the outer peripheral edge of the metal sheet 2 may be conducted in a manner other than that described in conjunction with FIG. 3.

In the embodiment, the shallow preliminary valleys 23 and the low preliminary peaks 24 are formed by punching in the preparation step. Depending on the material of the metal sheet 2, the depth of the preliminary valleys 23 formed by punching can be made substantially coincident with that of the valleys 31 of the metal sheet gear 3 which is a final shaped product. In this case, also the height of the preliminary peaks 24 formed in the punching step is substantially coincident with that of the peaks 32 of the metal sheet gear 3 which is a final shaped product. When a method in which the depth of the preliminary valleys 23 formed by punching in the punching step is made substantially coincident with that of the valleys 31 of the metal sheet gear 3 which is a final shaped product and the height of the preliminary peaks 24 is made substantially coincident with that of the peaks 32 of the metal sheet gear 3 which is a final shaped product is employed, therefore, it is possible to use the shaping roller 301 for only the surface finishing of the valleys 31 and the peaks 32. In other words, the method comprises: a punching step of punching out a number of places of an outer peripheral edge along metal sheet in an axial direction of the sheet metal, the places being arranged with a regular pitch, thereby forming valleys of a gear and peaks respectively existing between adjacent ones of the valleys; and a gear finishing step of fitting a valley-shaping face of a shaping roller having a peak-shaping face and the valley-shaping face into the valleys of the metal sheet, and the peak-shaping face of the shaping roller onto the peaks of the metal sheet, and rotating the shaping roller while following the metal sheet, thereby finishing surfaces of the valleys and the peaks of the metal sheet. According to the method also, the valleys 31 and the peaks 32 are accurately shaped and also the pitches of the peaks 32 and the valleys 31 become adequate.

What is claimed is:

1. A method of producing a sheet metal gear from a metal sheet having a planar surface, and with a shaping roller having a valley-shaping face and a peak-shaping face, the method comprising the steps of:

preparing the metal sheet by punching out a number of places on an outer peripheral edge of the metal sheet in a direction perpendicular to the planar surface of the metal sheet, the places being arranged with a regular pitch, thereby forming preliminary valleys for the sheet metal gear and preliminary peaks respectively existing between adjacent ones of the preliminary valleys;

fitting the valley-shaping face of the shaping roller into the preliminary valleys and the peak-shaping face onto the preliminary peaks;

rotating the shaping roller while following the metal sheet and pressing the shaping roller against the metal sheet, thereby increasing the depth of the preliminary valleys of the metal sheet to form shaped valleys of the metal sheet gear, and increasing the height of the preliminary peaks to form shaped peaks of the metal sheet gear;

using a metal sheet which is smaller in thickness than the peaks of the sheet metal gear to be shaped; and thickening the outer peripheral edge of the metal sheet precedent to said preparing.

2. A method of producing a sheet metal gear from a metal sheet having a planar surface and with a shaping roller having a valley-shaping face and a peak-shaping face, the method comprising the steps of:

punching out a number of places on an outer peripheral edge of the metal sheet in a direction perpendicular to the planar surface of the metal sheet, the places being arranged with a regular pitch, thereby forming valleys and peaks respectively existing between adjacent ones of the valleys;

fitting the valley-shaping face of the shaping roller into the valleys of the metal sheet, and the peak-shaping face onto the peaks of the metal sheet;

rotating the shaping roller while following the metal sheet, thereby finishing surfaces of the valleys and the peaks;

using a metal sheet which is smaller in thickness than the peaks of the sheet metal gear to be finished; and thickening the outer peripheral edge of the metal sheet precedent to said punching.

* * * * *

UNITED STATES PATENT AND TRADEMARK OFFICE

CERTIFICATE OF CORRECTION

PATENT NO. : 6,016,602

DATED : January 25, 2000

INVENTOR(S) : Toshiaki Kanemitsu et al

It is certified that error appears in the above-indentified patent and that said Letters Patent is hereby corrected as shown below:

Claim 1, column 10, line 36, "metal" (second occurrence) should be --sheet--;

line 37, "sheet gear" should be --metal gear--; and line 38, "metal sheet gear" should be --sheet metal gear--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*